US006815894B2

(12) United States Patent
Takagaki et al.

(10) Patent No.: US 6,815,894 B2
(45) Date of Patent: Nov. 9, 2004

(54) MERCURY-FREE ARC TUBE FOR DISCHARGE LAMP UNIT

(75) Inventors: Michio Takagaki, Shizuoka (JP); Shinichi Irisawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/252,042

(22) Filed: Sep. 23, 2002

(65) Prior Publication Data

US 2003/0067262 A1 Apr. 10, 2003

(30) Foreign Application Priority Data

Sep. 27, 2001 (JP) ..... P.2001-295865

(51) Int. Cl.[7] ..... H01J 1/62; H01J 61/18
(52) U.S. Cl. ..... 313/637; 313/638
(58) Field of Search ..... 313/637, 638

(56) References Cited

U.S. PATENT DOCUMENTS 5,402,037 A 3/1995 Irisawa et al.
6,005,346 A * 12/1999 Shaffner ..... 313/637
6,069,456 A * 5/2000 Fromm et al. ..... 313/637
6,294,861 B1 9/2001 Mochiduki et al.
6,392,346 B1 * 5/2002 Newell et al. ..... 313/637

* cited by examiner

*Primary Examiner*—Ashok Patel
(74) *Attorney, Agent, or Firm*—Sughrue Mion, PLLC

(57) ABSTRACT

A mercury-free arc tube having a closed glass bulb held between pinch seal portions located at opposite ends of the closed glass bulb and a pair of electrodes provided in the closed glass bulb. The closed glass bulb does not contain mercury (Hg), but contains a main light emitting, a buffer metal halide, and a starting rare gas enclosed in the closed glass bulb. The buffer metal halide includes a halide selected from halides of Ta, Th, Cu, Rb, Nb and Pd. Preferably, at least one of the halides is Ta, Cu, Rb or Nb. The halides serve as a buffer substance and a light emitting substance in substitution for the mercury, and have an ionization potential of about 5 to 8.5 eV and excitation potential of about 4.5 eV or less having emission spectrum in a visible range, and are sealed with the rare gas.

11 Claims, 3 Drawing Sheets

FIG. 2

| MATERIALS | | Ta | Th | Cu | Rb | Nb | Pd |
|---|---|---|---|---|---|---|---|
| ATOMIC NUMBER | | 73 | 90 | 29 | 37 | 41 | 46 |
| INCREASE OF TUBE VOLTAGE | | ◎ | ○ | ○ | × | △ | △ |
| INCREASE OF LIGHT FLUX | | △ | × | ○ | ○ | △ | △ |
| IMPROVING OF CHROMATICITY | TOTAL | △ | × | △ | ○ | ○ | △ |
| | RED | △ | | | ○ | △ | ○ |
| | GREEN | △ | | ○ | △ | △ | |
| | BLUE | △ | | △ | ○ | ○ | |
| ENCLOSING AMOUNT | UPPER LIMIT (mg) | 0.5 | 0.05 | 0.1 | 0.3 | 0.3 | 0.1 |
| | LOWER LIMIT (mg) | 0.01 | 0.001 | 0.05 | 0.001 | 0.001 | 0.01 |

MERCURY-FREE ARC TUBE FOR DISCHARGE LAMP UNIT

BACKGROUND OF THE INVENTION

1. Field of the Invention

The present invention relates to an arc tube for a discharge lamp unit, and in particular, to a mercury-free arc tube for a discharge lamp unit that uses a buffer metal halide as a buffer substance instead of mercury, providing an arc tube that is not as harmful to the environment as the related art mercury-based arc tube.

2. Description of the Related Art

FIG. 3 shows a discharge bulb which is a related art discharge lamp unit used as a light source of an automotive lamp. The discharge bulb has a structure in which an arc tube 2 having a closed glass bulb 2*a* as a light emitting portion is unified with an insulating plug body 1 made of synthetic resin. The arc tube 2 is gripped at its rear end portion by a metal support member 8 fixed to the insulating plug body 1, and the arc tube 2 is supported at its front end portion by a metal lead support 9 which also serves as a current conduction path extended out from the insulating plug body 1.

The arc tube 2 has a structure in which the main light emitting metal halide, the buffer mercury, and the starting rare gas are enclosed in the closed glass bulb 2*a* which is held between pinch seal portions 2*b* and 2*b* located at the opposite ends of the closed glass bulb 2*a*. Light is emitted by an arc generated through electric discharge between the pair of electrodes 3 and 3. The arc bulb is superior in a light-emitting amount to an incandescent bulb, and has a long lifetime. For this reason, nowadays there is a tendency for this type of discharge bulb to be used as a light source for a head lamp or a fog lamp of an automobile.

Reference numeral 4 designates a lead wire led out from the pinch seal portion 2*b*. Reference numeral 5 designates a molybdenum foil for connecting a tungsten-made electrode 3 to the lead wire 4. Further, the arc tube 2 is integrally welded to an ultraviolet-shielding shroud glass 6 to thereby form a structure in which the closed glass bulb 2*a* is surrounded by a closed space sectioned by the shroud glass 6. This configuration cuts-off ultraviolet rays in a wavelength range harmful to the human body from a light emitted from the arc tube 2, and concurrently keeps the closed glass bulb 2*a* at a high temperature.

In a related art closed glass bulb 2*a*, mercury is enclosed, but it is known that mercury is toxic to the environment. In response to the social needs of reducing causes of global environmental pollution as much as possible, it is desirable to develop a mercury-free arc tube, i.e., an arc tube not containing the mercury that is toxic to the environment.

The following findings have been obtained in the process of research and development on a mercury-free arc tube.

In the discharge lamp unit (the discharge bulb), current applied to the arc tube is adjusted by a ballast such that the arc tube is lit at rated power (for example, 35 W). The mercury enclosed in the closed glass bulb acts mainly as a buffer substance which helps the arc tube maintain a predetermined tube voltage (for example, 85 V) for rated power (for example, 35 W) to reduce damage to the electrodes due to increase of the tube voltage (increase of electron number colliding with the electrodes). The mercury acts also as a light emitting substance for emitting a predetermined emitting light (white light) in cooperation with the main light emitting metal halide. For this reason, if the mercury is removed from the closed glass bulb, the following changes (problems) occur in the characteristics as the arc tube.

First, the tube voltage goes down. Accordingly, the current applied to the discharge lamp unit (the discharge bulb) therefore increases, resulting in reducing damage to the electrode or a light emitting efficiency (the rate of the light emitting amount to the applied current).

Second, a light flux goes down by an amount that light emitted by the mercury is absent in a visible range.

Third, the color of emitted light is different (reddish) from the color of light emitted from the conventional mercury-containing arc tube.

SUMMARY OF THE INVENTION

The inventor selected a metal halide as a substitute for the mercury (and a non-toxic substance to the environment), sealed the metal halide in the closed glass bulb, and performed studies as to whether characteristics near to those of the related art mercury-containing arc tube could be obtained or not. As a result, the inventor discovered a mercury-free arc tube having similar lighting properties as that of the related art mercury arc-tube.

The invention is based on the problems in the prior art and the inventor's knowledge, and it is an object of the invention to provide a mercury-free arc tube for a discharge lamp unit in which characteristics near to or better than those of the related art arc tube can be obtained.

For accomplishing this object, according to a first aspect of the invention, a mercury-free arc tube for a discharge lamp unit comprises: a closed glass bulb held between pinch seal portions located at opposite ends of the closed glass bulb; and a pair of electrodes provided in the closed glass bulb so as to be opposite to each other, the closed glass bulb including a main light emitting metal halide, a buffer metal halide, and a starting rare gas enclosed in the closed glass bulb; wherein the buffer metal halide has ionization potential of about 5 to 8.5 eV and excitation potential of about 4.5 eV or less having emission spectrum in a visible range.

(Working)

In substitution for the related art mercury, the buffer metal halide enclosed in the closed glass bulb prevents a large reduction of the tube voltage and light flux owing to the bulb not containing any mercury, and contributes to dissolution of the first and second problems discussed above.

In addition, if at least one kind of the metal halides emitting light near to the light emissions of the mercury is selected to be enclosed in the closed glass bulb, reduction of the amount of emitting light or of the light flux is complemented in the visible range (the white light), which contributes to dissolution of the third problem discussed above.

However, if ionization potential of the buffer metal halide is too low (less than 5 eV), since electrons are emitted at low energy and the tube voltage does not rise sufficiently, and reversely, if ionization potential is too high (more than 8.5 eV), discharge is difficult to be stable by the amount that ionization is difficult, and the light emissions are less and the light flux does not rise sufficiently. Therefore, it is desirable that ionization potential of the buffer metal halide is within a range between about 5 and 8.5 eV where the tube voltage and the light flux are sufficient for lighting purposes.

Although ionization potential of the buffer metal halide ranges from about 5 to 8.5 eV, if excitation potential of this substance is too high (more than 4.5 eV), it is not ready for coming to emission, and therefore it is desirable that excitation potential of the buffer metal halide has an emitting spectrum being not so high but below 4.5 eV.

In a second aspect of the invention, in the mercury-free arc tube for a discharge lamp unit as set forth in the first aspect, the buffer metal halide may comprise one or more halides including Ta, Th, Cu, Rb, Nb and Pd. In a preferred embodiment, at least one of the one or more halides is Ta, Cu, Rb, or Nb.

(Working)

Substances used in the related art case may similarly be used as the main light emitting metal halide and the starting rare gas in the present invention. That is, the main light emitting metal halide may be a sodium-scandium based halide such as NaI and $ScI_3$, and the starting rare gas may be Xe.

The buffer metal halide used in place of the mercury is at least one kind selected from the group of Ta, Th, Cu, Rb, Nb and Pd. When the buffer metal halide is enclosed in the closed glass bulb, the great reduction in the tube voltage and the light flux caused by not using mercury can be suppressed, contributing to dissolution of the first and second problems.

In the preferred embodiment, at least one of the halides may be selected from halides of Ta, Cu, Rb, and Nb emitting light near to that of mercury and enclosed in the closed glass bulb. Therefore, the reduction of the amount of emitting light or of the light flux is complemented in the visible range (the white light), contributing to dissolution of the third problem.

In a third aspect of the invention, the mercury-free arc tube for a discharge lamp unit as set forth in the first and second aspects is structured such that a weight ratio of the buffer metal halide to the main light emitting metal halide is about 1 to 500%.

(Working)

If the weight ratio of the buffer metal halide to the main light emitting metal halide is less than about 1%, the light emission by the buffer metal halide is not sufficient and the light flux rises insufficiently. Reversely, being more than about 500%, the buffer metal halide is too much and impedes the light emission of the main light emitting metal halide, and so the light flux rises insufficiently. Therefore, desirably the weight ratio of the buffer metal halide to the main light emitting metal halide is about 1 to 500%.

BRIEF DESCRIPTION OF THE DRAWINGS

FIG. 2 is a table showing characteristics of the tube voltage of the buffer metal halide enclosed in the closed glass bulb, light flux, and chromaticity.

DETAILED DESCRIPTION OF THE PREFERRED EMBODIMENTS

The above and other objects and advantages of the present invention will become more apparent by describing in detail preferred embodiments thereof with reference to the accompanying drawings.

Figure 1:
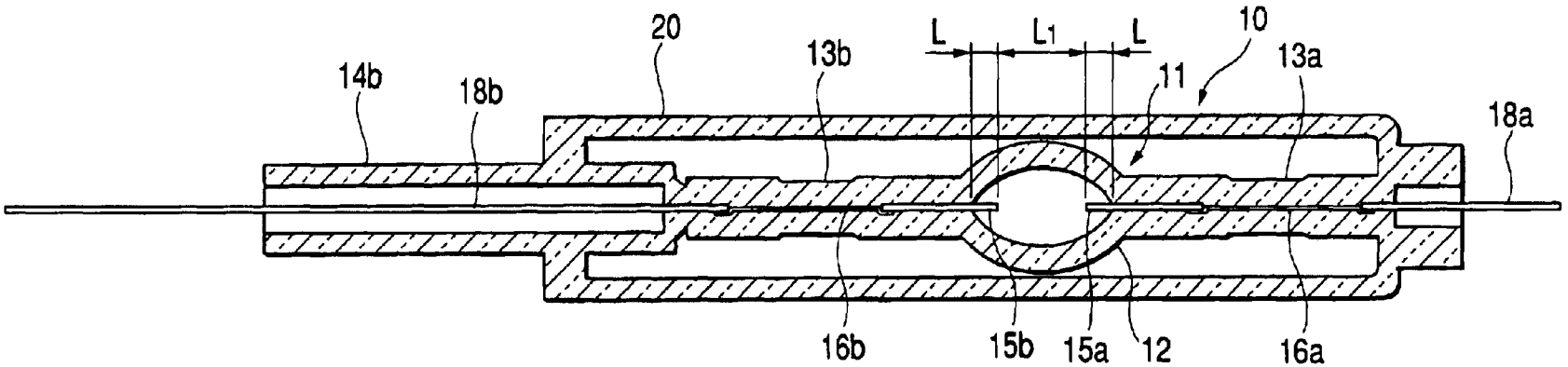
FIG. 1 is a vertically cross-sectional view of a first embodiment of the mercury-free arc tube for the discharge lamp unit.

FIG. 1 is a vertically cross-sectional view of a first embodiment of the mercury-free arc tube for the discharge lamp unit according to the invention, and FIG. 2 is a Table showing characteristics of the tube voltage of the buffer metal halide enclosed in the closed glass bulb, the light flux and chromaticities.

Figure 3:
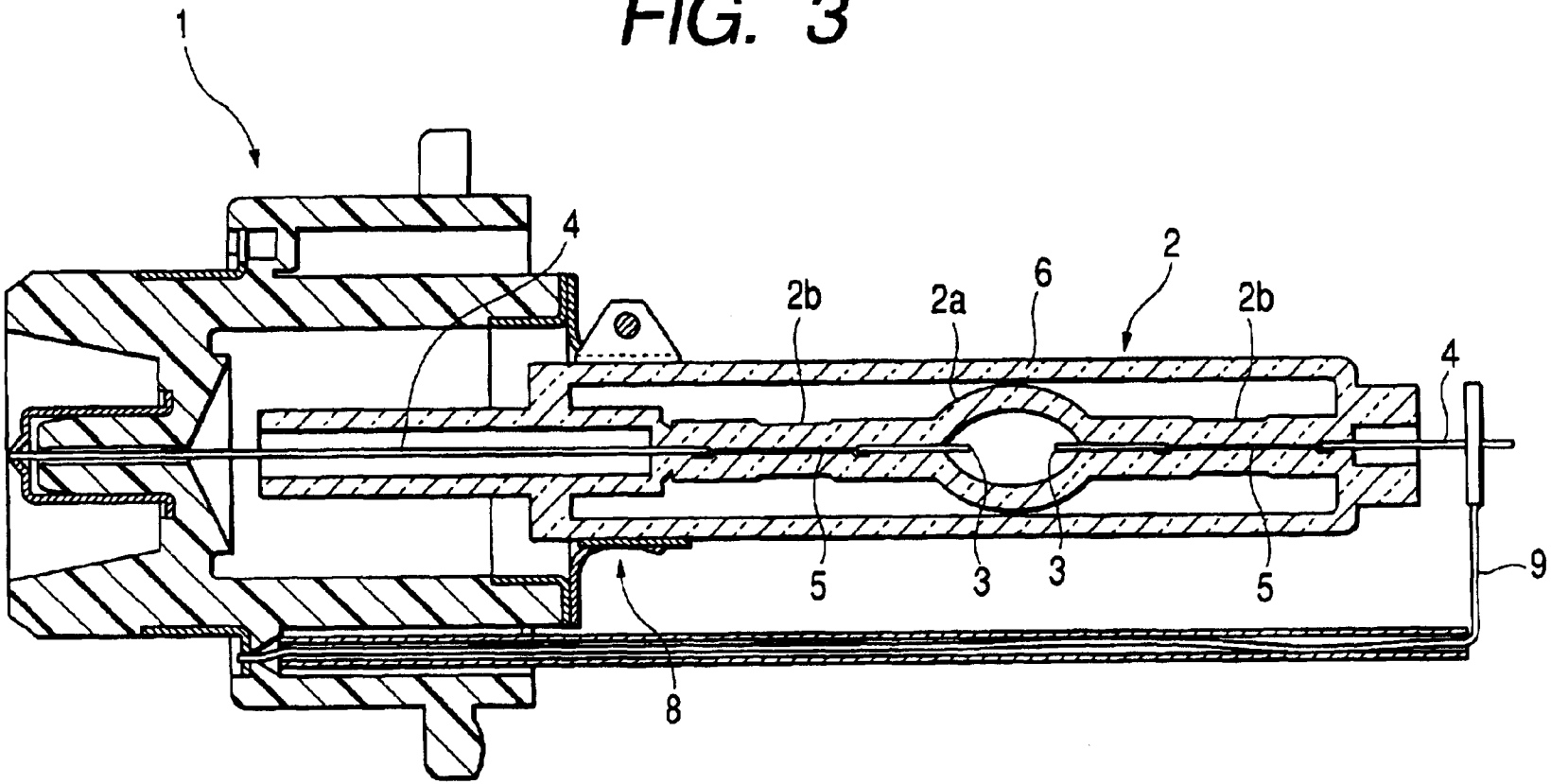
FIG. 3 is a vertically cross-sectional view of the related art discharge lamp unit.

In the drawing, reference numeral 10 designates the arc tube having a structure, in which a cylindrical ultraviolet-shielding shroud glass 20 is integrally welded (sealed) to an arc tube body 11 having a closed glass bulb 12 provided with a pair of electrodes 15*a* and 15*b* opposite to each other so that the closed glass bulb 12 is surrounded by and sealed with the ultraviolet-shielding shroud glass 20, and as shown in the related art example (FIG. 3), it is unified to an insulating base.

The arc tube body 11 may be processed from a circular pipe-shaped quartz glass tube, and have a structure in which the closed glass bulb 12 shaped in a rotary spheroid is formed, and is surrounded with pinch seal portions 13*a* and 13*b* shaped like a rectangle in cross section in a predetermined lengthwise position. Rectangular molybdenum foil 16*a* and 16*b* are sealed at the pinch seal portions 13*a* and 13*b*. One side of each of the molybdenum foil 16*a* and 16*b* is connected to tungsten electrodes 15*a* and 15*b*, while the other side is connected to lead wires 18*a*, 18*b* led outside of the arc tube body 11.

The arc tube body 11 is integrally welded to the cylindrical ultraviolet-shielding shroud glass 20 having a caliber larger than that of the closed glass bulb 12, so that a region extending from the pinch seal portions 13*a* and 13*b* of the arc tube body 11 to the closed glass bulb 12 is surrounded by and sealed with the ultraviolet-shielding shroud glass 20, while a circular pipe-like rear extending portion 14*b*, which is a non-seal portion of the arc tube body 11, is protruded to the rear of the shroud glass 20. The shroud glass 20 is constituted by a quartz glass doped with $TiO_2$ or $CeO_2$ and exhibiting an ultraviolet-shielding function. The shroud glass 20 is provided for surely cutting off ultraviolet rays in a predetermined wavelength range harmful to the human body from the light emitted from the closed glass bulb 12, which is an electric discharge portion.

In the glass bulb 12A, enclosed are the starting rare gas, the main light emitting metal halide, and the buffer metal halide substituted for the related art mercury. Thus, the mercury-free arc tubes exhibit characteristics similar to those of the related art mercury containing arc tube.

The main light emitting metal halide enclosed in the closed glass bulb may be NaI and $ScI_3$ being substances mainly contributing to the light emission.

The enclosed buffer metal halide serves as a buffer substance preventing a large reduction of the tube voltage in place of the related art mercury enclosed in the arc tube, and also serves as a light emitting substance in place of the mercury. The buffer metal halide may have an ionization potential of about 5 to 8.5 eV and excitation potential of about 4.5 eV or less having emission spectrum in a visible range.

If the ionization potential of the enclosed buffer metal halide is too low (less than 5 eV), since electrons are emitted at low energy and the tube voltage does not rise sufficiently, and reversely if ionization potential is too high (more than 8.5 eV), discharge is difficult to be stable by the amount that the ionization is difficult, and the light emission is reduced and the light flux does not rise sufficiently. Therefore, it is desirable that the ionization potential of the buffer metal halide is within a range between about 5 and 8.5 eV where the tube voltage and light flux are sufficient for lighting purposes.

Although the ionization potential of the buffer metal halide ranges from about 5 to 8.5 eV, if the excitation potential of this substance is too high (more than 4.5 eV), it is not ready for coming to emission, and therefore a light emitting substance may be preferably limited to the buffer metal halide having the excitation potential of being not too high but 4.5 eV or lower and having the emitting spectrum in the visible range. The buffer metal halide may be one kind or more selected from halides of Ta, Th, Cu, Rb, Nb and Pd.

A rare gas enclosed in the closed glass bulb 12 may be Xe, and sealing pressure may be 3 to 6 atm as in the related art.

Further, explanation will be specifically made to a non-limiting structure of the mercury-free arc tube.

A volume of the closed glass bulb 12 is 20 to 50 $\mu l$, a distance between the electrodes is 4.0 to 4.4 mm, a length L of protrusion of each electrode into the closed glass bulb is 1.8 to 2.0 mm, and an amount of enclosing the main light emitting metal halide is 0.2 to 0.4 mg. These structures are similar to those of the related art mercury-containing arc tube.

In an enclosed space between the shroud glass 20 and the arc tube body 11, an inert gas of 0.5 atm is enclosed for heat insulation against heat radiation from the closed glass bulb 12 being a discharging portion.

Different, however, from the related art mercury-containing arc tube are that the buffer metal halide enclosed in the closed glass bulb in substitution for the mercury includes such substances having the predetermined ionization potential and the excitation potential as mentioned above and having the emission spectrum in the visible range, and in addition, the buffer metal halide in substitution for the mercury may be one kind or more selected from halides of Ta, Th, Cu, Rb, Nb and Pd, and one kind of at least Ta, Cu, Rb and Nb.

By enclosing the buffer metal halide into the closed glass bulb, the tube voltage increases in comparison with the case when enclosing no mercury, and reduction of the tube voltage owing to omission of the mercury is restrained, thereby enabling obtainment of a tube voltage near to that (8.5 eV) of the related art mercury containing arc tube.

These buffer metal halides heighten the light flux than in the case of enclosing no mercury, and reduction of the tube voltage owing to omitting mercury is restrained, thereby enabling obtainment of a light flux near to that (3500 lm) of the related art mercury containing arc tube.

Each of metals such as Ta, Cu, Rb and Nb emit a light emitting color near to the light emission of the mercury (a light having a spectrum in a wave range in response to blue), and the metal halides serve to compensate reduction of the light flux and the light emitting color of mainly blue in the visible range owing to containing no mercury, and a chromaticity of the light emitting of the arc tube falls in a range determined by an ECE standard.

Further, the weight ratio of the enclosed buffer metal halide to the main light emitting metal halide is adjusted to range of about 1 to 500%.

Namely, if the weight ratio of the buffer metal halide to the main light emitting metal halide is less than about 1%, the light emission by the buffer metal halide is not sufficient and the light flux rises insufficiently. Reversely, being more than about 500%, the buffer metal halide is too much and impedes the light emission of the main light emitting metal halide, and so the light flux rises insufficiently. Therefore, it is desirable that the weight ratio of the buffer metal halide to the main light emitting metal halide is in a range of about 1 to 500%.

FIG. 2 is a Table showing characteristics of the tube voltage of the buffer metal halide enclosed in the closed glass bulb, the light flux, and the chromaticity, and results of investigating availability of the tube voltage, the light flux, and the chromaticity based on the above mentioned ionization potential and excitation potential.

As shown in FIG. 2, the metals effective for improving the tube voltage (heightening the tube voltage) are Ta, Th, Cu, Nb and Pd excepting Rb, and Ta is especially effective.

The metals effective for improving the light flux (heightening the light flux) are Ta, Cu, Rb, Nb and Pd excepting Th, and Cu and Rb are especially effective.

The metals effective for improving the chromaticity (the chromaticity is present in the white range of the ECE standard) are Ta, Cu, Rb and Nb, and Rb and Nb are especially effective.

Accordingly, in a preferred embodiment, the arc tube includes one or more halides of Ta, Th, Cu, Rb, Nb and Pd containing one kind of halide of at least Ta, Cu, Rb and Nb, in which a combination of halides effective to the tube voltage, light flux and chromaticity is selected, and enclosed in the closed glass bulb 12, so that such a mercury-free arc tube is available which is improved in the tube voltage, light flux, and chromaticity and has the characteristics near to or greater than those of the related art mercury-containing arc tube.

As apparent from the above explanation, according to the mercury-free arc tube for the discharge lamp unit of the first aspect of the invention, the buffer metal halide effective in improving the tube voltage, light flux, and chromaticity is specified by the ionization potential and free potential, so that it is easy to select the buffer metal halide to be enclosed in the closed glass bulb, and produce the mercury-free arc tube which has characteristics near to those of the related art mercury-containing arc tube. As a result, the arc tube of the present environment is not as harmful to the environment.

According to the second aspect of the invention, with the structure of enclosing the predetermined buffer metal halide in substitution for the mercury into the closed glass bulb, it is possible to offer the mercury-free arc tube which has characteristics near to those of the related art mercury-containing arc tube and is not as harmful to the environment.

According to the third aspect of the invention, the weight ratio of the buffer metal halide to the main light emitting metal halide is specified, and therefore it is easy to determine the amount of sealing of the buffer metal halide.

What is claimed is:

1. A mercury-free arc tube for a discharge lamp unit comprising:

a closed glass bulb held between pinch seal portions located at opposite ends of the closed glass bulb; and a pair of electrodes provided in the closed glass bulb so as to be opposite to each other, the closed glass bulb including a main light emitting metal halide, a buffer metal halide, and a starting rare gas enclosed in the closed glass bulb, wherein the buffer metal halide has an ionization potential of about 5 to 8.5 eV and an excitation potential of about 4.5 eV or less having an emission spectrum in a visible range.

2. The mercury-free arc tube for the discharge lamp as set forth in claim 1, wherein the buffer metal halide comprises one or more halides including Ta, Th, Cu, Rb, Nb and Pd.

3. The mercury-free arc tube for the discharge lamp as set forth in claim 2, wherein at least one of the one or more halides is Ta, Cu, Rb or Nb.

4. The mercury-free arc tube for the discharge lamp as set forth in claim 1, wherein a weight ratio of the buffer metal halide to the main light emitting metal halide is about 1 to 500%.

5. The mercury-free arc tube for the discharge lamp as set forth in claim 2, wherein a weight ratio of the buffer metal halide to the main light emitting metal halide is about 1 to 500%.

6. The mercury-free arc tube for the discharge lamp as set forth in claim 1, wherein the buffer metal halide comprises one or more halides including Ta, Th, Cu, Nb and Pd.

7. The mercury-free arc tube for the discharge lamp as set forth in claim 6, wherein at least one of the one or more halides is Ta, Cu or Nb.

8. The mercury-free arc tube for the discharge lamp as set forth in claim 1, wherein the main light emitting metal halide comprises one of NaI and Sc13.

9. The mercury-free arc tube for the discharge lamp as set forth in claim 8, wherein the buffer metal halide comprises one or more halides including Ta, Th, Cu, Nb and Pd.

10. The mercury-free arc tube for the discharge lamp as set forth in claim 9, wherein at least one of the one or more halides is Ta, Cu or Nb.

11. A mercury-free arc tube for a discharge lamp unit comprising:

a closed glass bulb held between pinch seal portions located at opposite ends of the closed glass bulb; and a pair of electrodes provided in the closed glass bulb so as to be opposite to each other, the closed glass bulb including a main light emitting metal halide comprising one of NaI and ScI3, a buffer metal halide, and a starting rare gas enclosed in the closed glass bulb, wherein the buffer metal halide comprises one or more halides including Ta, Th, Cu, Nb and Pd, and at least one of the one or more halides is Ta, Cu or Nb.

* * * * *